US006978964B2

(12) United States Patent
Beccari

(10) Patent No.: US 6,978,964 B2
(45) Date of Patent: Dec. 27, 2005

(54) APPARATUS FOR SUPPLYING A RIBBON-LIKE MATERIAL TO ONE OR MORE WORK MACHINES AND COMPONENT PARTS OF SAID APPARATUS

(75) Inventor: Cesare Beccari, Bologna (IT)

(73) Assignee: Bierrebi S.p.A., Zola Predosa (IT)

( * ) Notice: Subject to any disclaimer, the term of this patent is extended or adjusted under 35 U.S.C. 154(b) by 35 days.

(21) Appl. No.: 10/250,443

(22) PCT Filed: Dec. 19, 2001

(86) PCT No.: PCT/IB01/02607

§ 371 (c)(1),
(2), (4) Date: Jul. 1, 2003

(87) PCT Pub. No.: WO02/057165

PCT Pub. Date: Jul. 25, 2002

(65) Prior Publication Data

US 2004/0041056 A1 Mar. 4, 2004

(30) Foreign Application Priority Data

Jan. 19, 2001 (IT) ..... BO2001A0018

(51) Int. Cl.[7] ..... B65H 19/12; B65G 1/127
(52) U.S. Cl. ..... 242/559; 414/277
(58) Field of Search ..... 242/559, 559.1, 242/559.3, 559.4, 560, 564.5; 414/277, 279, 414/283, 911

(56) References Cited

U.S. PATENT DOCUMENTS

| | | | | |
|---|---|---|---|---|
| 2,549,239 | A * | 4/1951 | Robertson et al. | 242/559.4 |
| 3,782,649 | A * | 1/1974 | Frederick et al. | 242/564.5 |
| 4,331,418 | A * | 5/1982 | Klebe | 414/277 |
| 4,726,725 | A * | 2/1988 | Baker et al. | 414/283 |
| 5,067,871 | A * | 11/1991 | Hilber | 414/911 |
| 5,195,690 | A * | 3/1993 | Cross et al. | 242/564.5 |
| 5,286,157 | A | 2/1994 | Vainio et al. | |
| 5,472,153 | A | 12/1995 | Crowley et al. | |
| 5,599,155 | A * | 2/1997 | Rohm et al. | 414/283 |
| 5,716,022 | A | 2/1998 | Chiloff | |
| 6,062,794 | A * | 5/2000 | Shiba | 242/559.4 |
| 6,264,133 | B1 * | 7/2001 | Herrmann | 242/559.3 |
| 6,685,130 | B2 * | 2/2004 | Stauber et al. | 242/559.4 |

FOREIGN PATENT DOCUMENTS

| | | |
|---|---|---|
| DE | 100 26 589 | 12/2001 |
| EP | 0 950 626 | 10/1999 |
| GB | 2 294 033 | 4/1996 |
| WO | WO 00/56644 | 9/2000 |

* cited by examiner

*Primary Examiner*—William A. Rivera
(74) *Attorney, Agent, or Firm*—Young & Thompson

(57) ABSTRACT

Apparatus for supplying a ribbon-like material or fabric to one or more machines for cutting the material, comprising a reel storage having a plurality of housings for storing a respective reel, elements for supplying the material to a respective machine, elements for drawing a respective reel of the ribbon-like material. Control elements are provided to command the gripping of a real, by the drawing elements, from the predefined housing and the delivery of this reel to the elements for delivering the material of a respective work machine and, vice versa, to command, by the drawing elements, the gripping of the reel, partially or totally used in the machine, by the elements for supplying the material, and the release of this reel to the corresponding housing in the storage.

29 Claims, 3 Drawing Sheets

APPARATUS FOR SUPPLYING A RIBBON-LIKE MATERIAL TO ONE OR MORE WORK MACHINES AND COMPONENT PARTS OF SAID APPARATUS

TECHNICAL FIELD

The present invention relates to an apparatus for supplying a ribbon-like material, in particular a fabric or the like, to one or more machines for working said material.

BACKGROUND ART

In the field related to the cutting of pieces or patches of fabric, or similar material, into appropriately shaped portions, in particular for manufacturing suits or other clothing items, cutting machines are used which have a jigsaw that simultaneously operates on a certain quantity of superposed layers (numbering a few tens, for instance 40–50 layers), which are stacked on a bristle support and held there by means of a vacuum appropriately applied from the side of said bristle support.

To feed the fabric to be cut to said prior art machines, in manufacturing plants appropriate folding apparatuses are employed, which unroll the ribbon-like material from a respective reel arranging it in zigzag fashion, in such a way as to define a plurality of superposed layers, which must then be transferred, for their simultaneous cut, on the bristle cutting plane of known machines.

In practice, according to the procedure for supplying or feeding the ribbon-like material which is the basis for the operation of said known manufacturing plants, the ribbon-like material, which is supported by a single reel, is completely unrolled. For such prior art machines, it is neither envisaged nor economically practical to use the ribbon-like material of a respective reel only partially, in view of cutting fabric portions destined to the manufacture of a limited number of clothing items.

With prior art machines, therefore, there is a tendency to produce an excessive number of fabric cuts for an overabundant number of clothing items, which risk remaining unsold with the deriving economic losses for the manufacturing companies; conversely, if demand is only limited to a small number of said clothing items, it is preferred to forego such production runs, with the deriving loss of the work order and related revenues.

In prior art plants, moreover, said folding apparatuses are complex, costly, and with an insufficient operating rate, which entails excessive delays in the supply to the cutting machines downstream of the folding machines. The entire production cycle of the plant is thus slowed down.

A further drawback that is present in prior art systems concerns the way in which the reels are positioned in the unrolling station associated to the folding device. The reels supporting the ribbon-like material must be kept raised by pincers or the like, which engage the end parts of the reel and/or of the support core, to allow the insertion of a respective support shaft of the unrolling station, which is inserted into the central hole provided in the support core of the reel Said core for supporting the ribbon-like material of the reel is made of cardboard, which is easily deformed by flexing and is of poor quality, which makes it performing such loading operations at the unrolling station difficult and awkward. In extreme cases, when the ribbon-like fabric is particularly delicate, the execution of such operations could even cause damage to said product.

DISCLOSURE OF THE INVENTION

As set out in claim 1, in accordance with the present invention an apparatus is provided for supplying a ribbon-like material, in particular a fabric or the like, to one or more machines for working said material, in particular one or more machines for cutting the material into appropriately shaped portions, said apparatus comprises a storage bay having a plurality of predefined storage housings for a respective support reel of a respective ribbon-like material, means for supplying the material to the respective machine, means for drawing a respective reel, and control means able to command said drawing means to take a reel from a predefined housing and deliver it to said means for supplying the material of a respective work machine and, vice versa, to command said drawing means to take the partially or totally used reel from said means for supplying the material and deliver said reel to the corresponding housing the aforesaid storage bay.

In this way, the operation of supplying the material to the machine is made extremely flexible as a function of the specific requirements of each individual production run. With the present system or apparatus it is possible automatically to feed, to the downstream work machines, any quantity of material, even a limited quantity.

The supply of material to the downstream work machines is, thanks to the present apparatus, made extremely faster, overcoming to the maximum extent the considerable idle times which are instead present in prior art plants.

Moreover, it is possible, without the need for any intervention by personnel, to supply to a machine the reel of the material having the characteristics, for instance colour, quality and type of fabric, required for the current work process. All that is needed is automatically to draw the reel of desired material, housed inside a predefined housing, from the storage bay.

The secondary claims describe other advantageous aspects of the invention.

The present invention further relates to the individual component parts of this apparatus, such as a reel storage bay, a device for supplying the material to a respective work machine, a device for drawing a reel and an organ for gripping said reel.

DESCRIPTION OF THE DRAWINGS

The invention, in its technical characteristics and in its different advantageous aspects, shall become more readily apparent from the detailed description that follows, made with reference to the accompanying drawings, which represent an embodiment provided purely by way of non limiting example, in which.

DESCRIPTION OF THE ILLUSTRATIVE EMBODIMENT

The present apparatus is preferably used upstream of machines for cutting fabric of the kind described in International Patent Application no. PCT/IB00/01781, of the same Applicant and whose content shall be deemed as an integral part of the present description.

Figure 1:
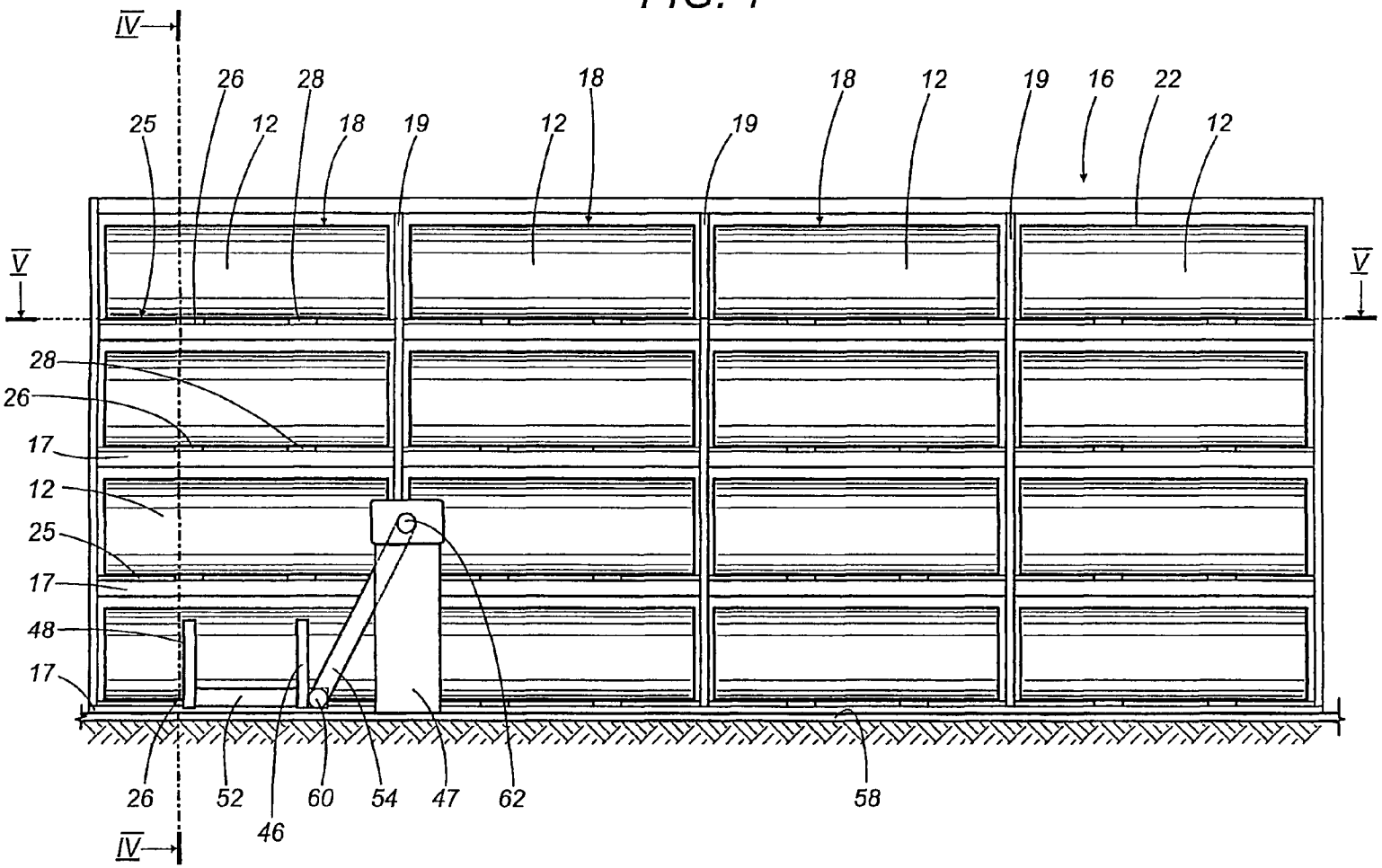
FIG. 1 is a front view showing the reel storage bay and the drawing and transferring robot of an apparatus according to a preferred embodiment of the present invention.
Figure 2:
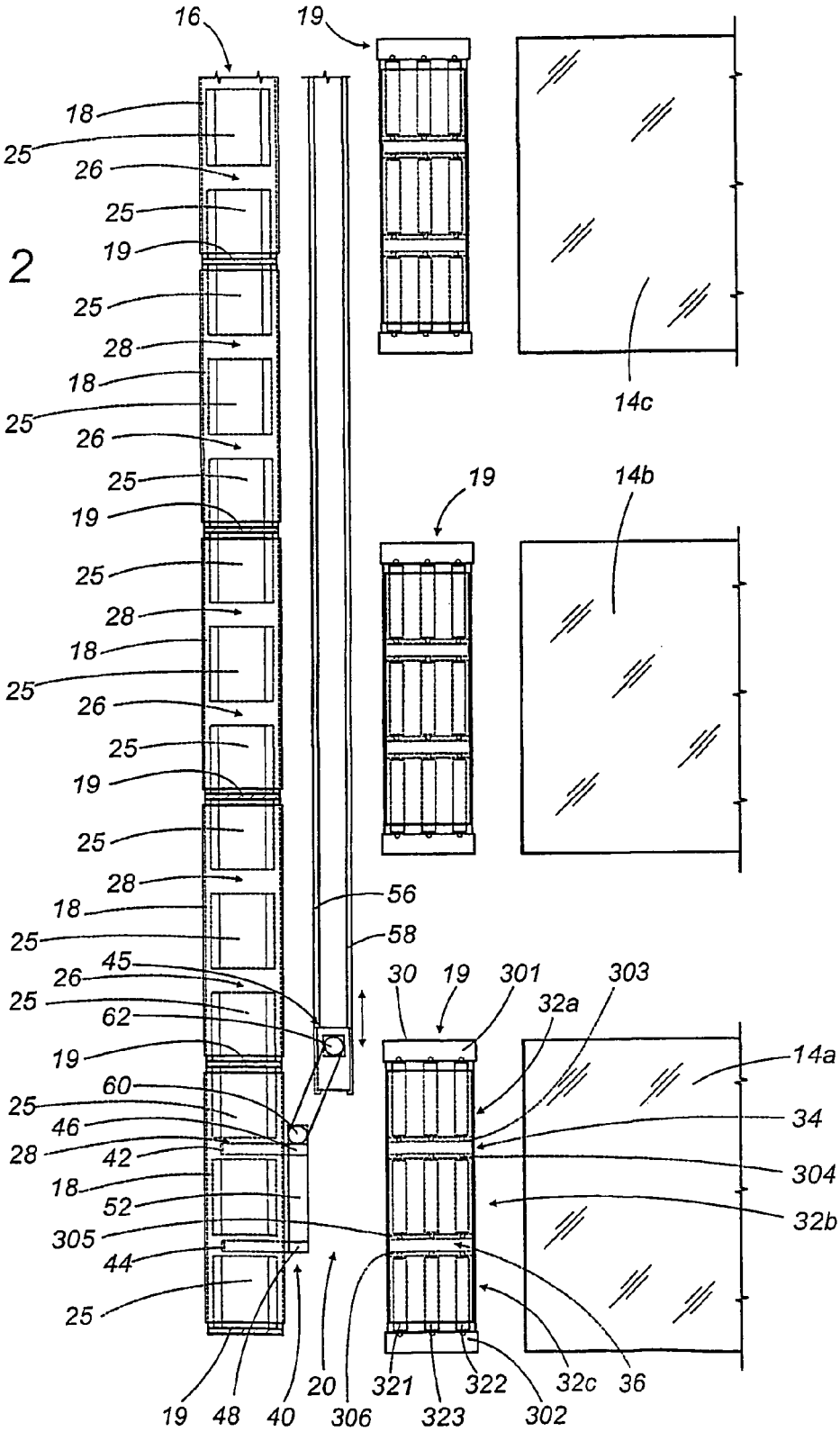
FIG. 2 shows a horizontal section view, taken according to the line V—V of FIG. 1, of the preferred embodiment of apparatus of the present invention.
Figure 3:
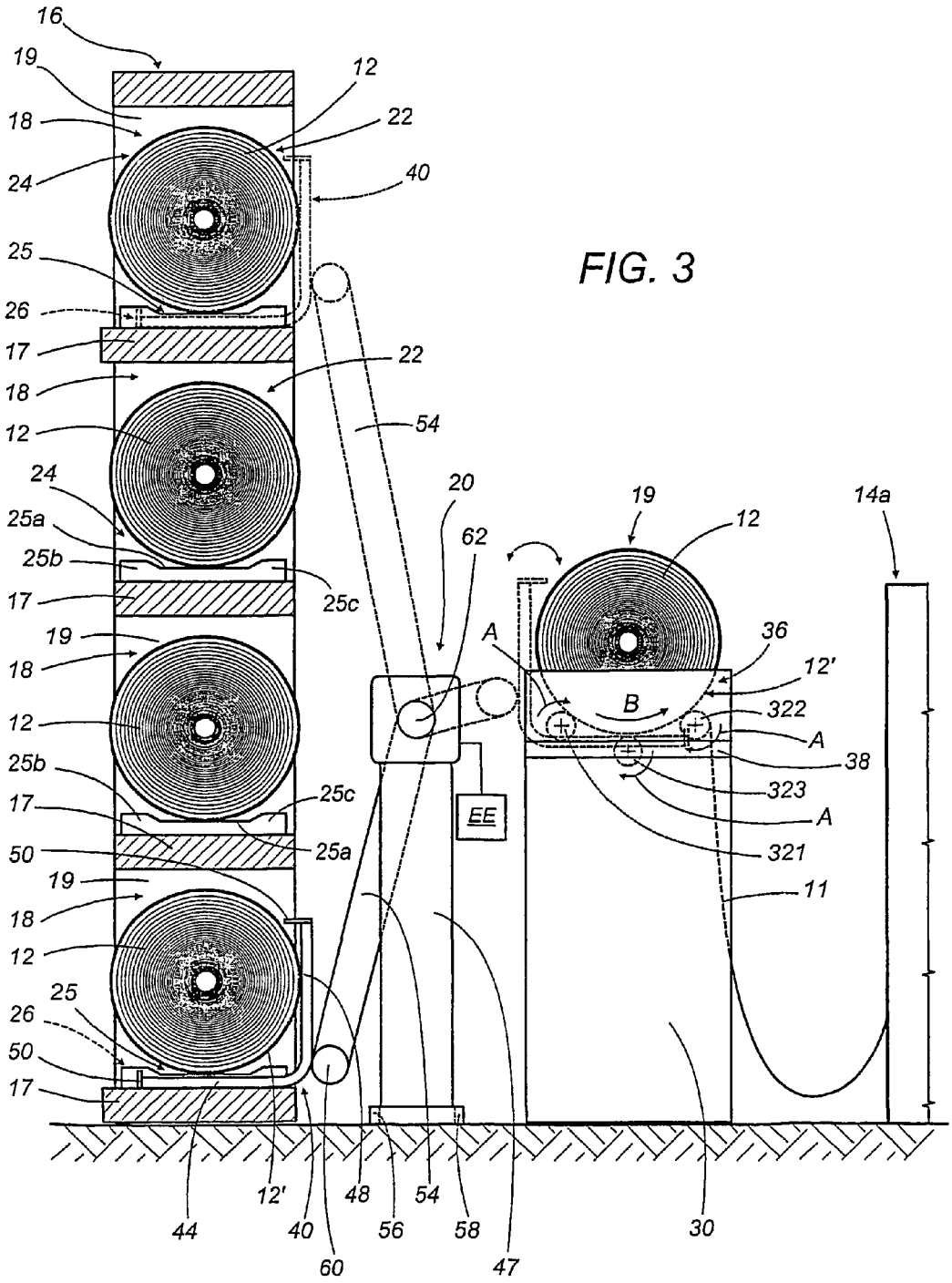
FIG. 3 shows a longitudinal section view, taken according to the line IV—IV of FIG. 1, of the preferred embodiment of apparatus of the present invention.

With reference to FIGS. 1, 2 and 3 of the accompanying drawings, a preferred embodiment is illustrated hereafter of an apparatus for supplying a reel of material 12, in particular a reel of fabric or the like, to one or more machines working said material, indicated in schematic fashion and marked with the numeric references 14*a*, 14*b*, 14*c* in the aforementioned figures.

The present apparatus comprises a reel storage bay 16 having a plurality of storage housings 18 for a respective reel 12 and it has a structure extending transversely to the work machines 14*a*, 14*b*, 14*c*, which defines a plurality of horizontal planes 17 which are subdivided, by vertical walls 19, into housing compartments 18 for respective reels 14.

In practice, each compartment or housing 18 has a predefined position (determined for example by its spatial coordinates with respect to one or more reference points) and in each of them is positioned a reel of material having predefined characteristics.

As can be observed with particular reference to FIGS. 1 and 2, the housings 18 for the reels 12 have a support base 25 for the reel 12 and at least a first and a second slits 26, 28 for the insertion of the tines 42, 44 of a fork 40 for drawing the reel—which shall be better described farther on—which slits open superiorly to allow the lifting of the aforesaid reel.

As it is particularly evident in FIG. 3, said support base 25 has a substantially horizontal support surface 25*a* for the reel 12 and a first and a second end longitudinal projections 25*b*, 25*c* which extend to a higher level of the aforesaid support plane for retaining said reel within said housing.

Said base 25 is particularly advantageous because it allows easily to draw the reel and provides it with such a support as to eliminate any flexural deformation, which would risk, especially in case of prolonged stationing of the reel on the support plane, to damage the supported fabric.

The present apparatus further comprises means 19 for supporting, unrolling and supplying the material to the respective machine 14*a*, 14*b*, 14*c*.

Said device or means 19 for supporting, unrolling and supplying the material to the respective machine 14*a*, 14*b*, 14*c* is in the form of rotating roller means suitable for supporting and unrolling the material of the reel 12.

Said roller means are supported on an appropriate support frame 30 and comprise a plurality of sections set transversely side by side 32*a*, 32*b*, 32*c*, which are such as to define at least a first and a second insertion passage 34, 36 for the tines of a fork for drawing the reel 12, which are open superiorly to allow, as shall be described better farther on, the lifting of said reel.

In particular, each section 32*a*, 32*b*, 32*c* of said rollers comprises at least a first and a second longitudinally distanced rollers 321, 322, situated at the same level or height, whereon the reel 12 is set with its outer surface 12'.

Each section 32*a*, 32*b*, 32*c* of said rollers further comprises a third roller 323 placed in an intermediate longitudinal position relative to said first and second roller 321,322, and situated at a lower level than them, to define an additional support point for the outer surface 12' of the reel, such as to obtain a sort of "cradle" configuration to support the outer surface of said reel.

To provide for the unrolling rotation of said reel, said rollers 321, 322, 322 are made to rotate as shown by the arrows A of FIG. 3, commanded by appropriate motor actuation means, which are not particularly shown in the accompanying figures and which are anyway known by the person versed in the art.

As particularly shown in FIG. 2, the rollers 321, 322, 323 of said sections of rollers 32*a*, 32*b*, 32*c* are supported in rotary fashion by means of the lateral vertical walls 301, 302 and intermediate walls 303, 304, 305, 306 of said frame 30, in such a way that said passages for the tines of the fork are defined between respective intermediate walls 303, 304, 305, 306, which further define means able laterally to guide said tines of the fork during their introduction into said passages 34, 36.

A horizontal transverse plane 38 inferiorly delimits said passages 34, 35 defining lower guidance means for said tines of the drawing fork.

The present apparatus also has means 20 for drawing, transferring and releasing a respective reel 12.

Said means or device 20 for drawing a respective reel 12 comprise an organ 40 for gripping or drawing the reel having at least a first and a second mutually parallel tines 42, 44. In this way, it is possible to support the reels in correspondence with intermediate points, reducing the flexural deformation effect that risks damaging the product and renders reel actuation operations awkward.

The gripping or drawing organ 40 further comprises a second pair of tines 46, 48 extending mutually parallel and substantially orthogonal to said first and second tines 42, 44. As shall be better described farther on, such a structure of the fork 40 allows the execution of an effective upsetting of the fork.

As shown, each of said tines 42, 44, 46, 48 ends with a portion 50, projecting perpendicularly relative to the tine, able to allow the retaining of said reel 12, especially on the occasion of the upsetting of fork 40, as shall be described better farther on.

As shown especially in FIG. 2, said fork 40 for gripping the reel further comprises a cross member 52 supporting said tines 42, 44, 46, 48.

The means 20 for drawing, transferring and releasing a respective reel 12 further comprise a movable assembly 45 having support means for said organ 40 for gripping the reel, which are, as shown in the figures, in the form of a movable arm 54.

Preferably said movable assembly 45 is in the form of an "anthropomorphic" robot having a column body 47 able to slide on guiding tracks 56, 58 extending parallel to the front face of said storage bay 16.

Said movable assembly is commanded to move along the tracks through appropriate actuating means (not shown in the accompanying figures and anyway well known to the person versed in the art).

As shown, said guiding tracks 56, 58 extend, advantageously from the point of view of bulk, between said storage bay 16 and said means for supplying the material to the working machines 14*a*, 14*b*, 14*c*.

Advantageous means are provided to cause the fork 40 to rotate by at least 90° in the two opposite angular directions, in order to obtain the upsetting of said fork 40. The arm means 54 for supporting and actuating the fork 40 comprise, for this purpose, a joint 60 able to make said fork 40 effect said rotation of at least 90°, in the two opposite angular directions. In this way it is possible, by performing a simple operation of upsetting the fork 40, to present the reel immediately to said supplying and unrolling roller means 19 or to said housing storage bay 16.

The arm 54 is, in turn, connected to the body of said movable assembly by means of a ball joint 62 which allows a three-dimensional rotation of said arm 54, in order to allow the attainment of any desired position of said means 40 for gripping or drawing the reel.

Appropriate means for actuating the arm 54 and rotating the fork 40 are provided, however they are not expressly shown in the figures as they are known to the person versed in the art.

The present apparatus, i.e. the robot 20 further comprises appropriate control means EE, schematically indicated in FIG. 3, which are able to command the gripping of a reel 12, by said drawing means 20, from a predefined housing 18 and the delivery to said means 19 for supporting, unrolling and supplying the material of a respective work machine 14*a*, 14*b*, 14*c*, and vice versa, to command the gripping of the reel, partially or totally used by the respective machine, by said means 19 for supporting, unrolling and supplying the material and the release of said reel 12 to the corresponding housing 18 in the aforesaid storage bay 16.

Said control means are in the form of at least an electronic computer EE, having at least a memory, means for inputting/outputting the signals and/or data and a processor operating under the control of a computer programme, able to command said drawing means in accordance with a predefined work sequence.

In practice, said control means store in the memory the position, in a respective storage bay housing, of a determined reel having predefined characteristics, and, when the work sequence of the cutting machine requires it, they automatically go fetch said reel to provide it to the cutting machine that requires it. Once the material of this reel has been used, said drawing means are commanded by said work programme to take said reel from the respective unrolling device and return it to its predefined housing compartment.

In this way, one obtains the nearly full complete automation of the operation of supplying the material to the work machine, achieving a considerable saving in terms of manpower and production costs.

In this way, moreover, the operation of supplying the material to the machine is made extremely faster.

It is also possible, without the need for any intervention by personnel, to supply to a machine the reel of material having the characteristics, for instance colour, quality and type of fabric, that are required for the work processes in progress.

Furthermore, as can be noted in particular from FIG. 2, said compartments 18, advantageously, have a front opening 22, defining a front access for drawing the reels 12, and an opposite rear opening 24, defining a rear access for loading a new reel 12 in the respective housing 18.

In this way, the loading of fall reels and the unloading of empty reels can be performed easily, without hampering the operation of supplying the material to the work machines.

The operation of the present apparatus is, briefly, as follows. The reel of material 12, positioned on said rollers 19, is unrolled, by rolling, according to the arrow B, on said rollers thanks to the action that they impart to the exterior peripheral layer of the reel by effect of the respective actuation in rotation, progressively transferring the ribbon-like material to the cutting machine. A strip of said fabric which has been unrolled from the reel 12 and which is suspended between said reel and the machine 14*a* is indicated with the numeric reference 11 in FIG. 3.

Once the cutting operation is completed in the respective machine downstream of the specific material or fabric of the reel being worked at that moment, the electronic computer EE commands the robot 20 to insert the tines 46, 48 into the passages 34, 36, between the sections of the respective roller set 19, and the subsequent lifting of said reel from said device 19. Subsequently, still under the control of the aforesaid electronic computer EE, the fork 40 is upset by 90° and the robot 20 is commanded to move along the tracks 56, 58 and the arm 54 is positioned at the appropriate height to insert the fork into the predefined compartment 18 for the transported reel. Once the robot has positioned the fork in the compartment 18, with lowering motion, it sets the reel 12 down onto the upper surface of the base 25 and, inserting itself into the longitudinal slits 26, 28 provided therein, disengages the fork of the reel 12. The robot then extracts the fork 40 from the compartment 18, leaving the reel set down on the support plane 25*a*.

At this point, the electronic processing means command the robot to go position itself in correspondence with a compartment 18 of an additional reel of material to be subjected to work process and to insert the tines 42, 44 into the slits 34, 36 of said additional compartment.

With a lifting motion of the fork it is possible to engage and delicately lift the new reel and to extract it from the compartment 18 with backwards motion, towards the work machines, in the longitudinal direction. By upsetting the fork by 90°, rotating the arm 54 and moving the robot longitudinally along the tracks it is possible to position the reel in correspondence with the roller "cradle" 19 of the corresponding machine and with lowering motion of the fork, with the insertion of the tines into the passages 34, 36, to release said reel to the roller set 19.

The insertion of the piece 11 of the ribbon-like material of the reel to the machine can be effected manually by personnel.

The present apparatus enables to execute the operation of supplying the material to the cutting machines, even having very limited manoeuvring spaces available.

The invention thus conceived can be subject to numerous modifications and variations, without thereby departing from the scope of the inventive concept. Moreover, all components can be replaced with technically equivalent elements.

What is claimed is:

1. Apparatus for supplying a ribbon-like material, in particular a fabric, to at least one work machine (14*a*, 14*b*, 14*c*) of said material, in particular to at least one machine for cutting the material into predetermined shaped portions, said apparatus comprising a storage bay (16) having a front end and a plurality of predefined housings (18) for storing a respective individual reel (12) supporting a respective ribbon-like material, said housings (18) comprising a plurality of housings (18) horizontally and vertically distributed, each housing having a front opening (22) for the drawing of the reels (12) which are on the same front side of the storage bay;

means (19) for supplying the material to the machine (14*a*, 14*b*, 14*c*), means (20) for drawing a respective reel (12) between the front side of the storage bay (16) and said means (19) for supplying the material to a respective machine; and control means (EE) able to command the gripping of a reel (12), by said drawing means (20), from a predefined housing (18)

and the delivery to said means (19) for delivering the material of a respective work machine (14*a*, 14*b*, 14*c*) and, vice versa, to command, by said drawing means (20), the gripping of the reel by the same means (19) for supplying the ribbon-like material, and the release of said reel (12) to the corresponding housing (18) in said storage bay (16).

2. Apparatus as claimed in claim 1, wherein said housings (18) have a front access for the drawing of the reels (12) and a rear access for the loading of a new reel (12) into the respective housing (18).

3. Apparatus as claimed in claim 1, wherein said means (20) for drawing a respective reel (12) comprise an organ for gripping the reel (40) having at least a first and a second mutually parallel tines (42, 44).

4. Apparatus as claimed in claim 3, wherein said gripping organ (40) has a second pair of tines (46, 48) extending parallel to each other and substantially orthogonal to said first and second tines (42, 44).

5. Apparatus as claimed in claim 3, wherein each of said tines (42, 44, 46, 48) has a free end having a portion (50) that projects perpendicularly from the respective tine to retain said reel (12).

6. Apparatus as claimed in claim 1, wherein said drawing means (20) comprise at least a movable assembly (45) having means (54) for supporting said organ (40) for gripping the reel.

7. Apparatus as claimed in claim 6, wherein said support means for the gripping organ (40) are in the form of a movable arm (54).

8. Apparatus as claimed in claim 6, wherein said movable assembly (45) is movable between said storage bay (16) and said means for supplying the material to the work machines (14*a*, 14*b*, 14*c*).

9. Apparatus as claimed in claim 6, wherein said movable assembly is actuated to move along guiding tracks (56, 58) which extend parallel to the drawing face of said storage bay (16).

10. Apparatus as claimed in claim 1, wherein said means (20) for drawing a respective reel (12) comprise an organ for gripping the reel (40) and means that are provided to impart a rotation, in the two opposite angular directions, to obtain the upsetting of said organ (40) for gripping the reel.

11. Apparatus as claimed in claim 1, wherein said means (19) for supplying the material to the respective machine (14*a*, 14*b*, 14*c*) are means for supporting and unrolling the material from the reel (12) in the form of roller means subdivided into a plurality of sections set transversely side by side (32*a*, 32*b*, 32*c*) such as to define at least a first and a second passage (34, 36) for the insertion of the tines of a fork for drawing the reel (12).

12. Apparatus as claimed in claim 11, wherein each section (32*a*, 32*b*, 32*c*) of said rollers comprises at least a first and a second longitudinally distanced roller (321, 322), situated at the same level or height, whereon the reel (12) is laid down with its outer surface (12').

13. Apparatus as claimed in claim 12, wherein each section (32*a*, 32*b*, 32*c*) of said rollers comprises a third roller (323) placed in intermediate longitudinal position relative to said first and second roller (321, 322), and situated at a lower level relative thereto, to define a further bearing point for the substantially cylindrical outer surface (12') of the reel (12).

14. Apparatus as claimed in claim 11, wherein lateral guidance means for the tines of the organ for gripping the reel, when they are introduced into said insertion passages (34, 36), are provided on said means (19) for supplying the material to the respective machine (14*a*, 14*b*, 14*c*).

15. Apparatus as claimed in claim 11, wherein the rollers (321, 322, 323) of said roller sections (32*a*, 32*b*, 32*c*) are supported able to rotate by means of lateral vertical walls (301) and intermediate walls (303, 304, 305, 306) of said frame (30) in such a way that said passages (34, 36) for the tines of the fork are defined between respective intermediate walls (303, 304, 305, 306), providing said lateral guidance means for the tines of the reel grip organ which are introduced into said passages (34, 36).

16. Apparatus as claimed in claim 1, wherein said housings (18) have a bearing base (25) for the reel (12) and at least a first and a second slit (26, 28) for the insertion of the tines (42, 44) of a fork (40) for drawing the reel (12).

17. Apparatus for supplying a ribbon-like material, in particular a fabric, to at least one work machine (14*a*, 14*b*, 14*c*) of said material, in particular to at least one machine for cutting the material into predetermined shaped portions, said apparatus comprising a storage bay (16) having a plurality of predefined housings (18) for storing a respective individual reel (12) supporting a respective ribbon-like material, means (19) for, supplying the material to the machine (14*a*, 14*b*, 14*c*), means (20) for drawing a respective reel (12); and control means (EE) able to command the gripping of a reel (12), by said drawing means (20), from a predefined housing (18)

and the delivery to said means (19) for delivering the material of a respective work machine (14*a*, 14*b*, 14*c*) and, vice versa, to command, by said drawing means (20), the gripping of the reel by said means (19) for supplying the ribbon-like material, and the release of said reel (12) to the corresponding housing (18) in said storage bay (16);

wherein the housings (18) have a front access for the drawing of the reels (12) and a rear access for the loading of a new reel (12) into the respective housing (18).

18. Apparatus for supplying a ribbon-like material, in particular a fabric, to at least one work machine (14*a*, 14*b*, 14*c*) of said material, in particular to at least one machine for cutting the material into predetermined shaped portions, said apparatus comprising a storage bay (16) having a plurality of predefined housings (18) for storing a respective individual reel (12) supporting a respective ribbon-like material, means (19) for supplying the material to the machine (14*a*, 14*b*, 14*c*), means (20) for drawing a respective reel (12); and control means (EE) able to command the gripping of a reel (12), by said drawing means (20), from a predefined housing (18)

and the delivery to said means (19) for delivering the material of a respective work machine (14*a*, 14*b*, 14*c*) and, vice versa, to command, by said drawing means (20), the gripping of the reel by said means (19) for supplying the ribbon-like material, and the release of said reel (12) to the corresponding housing (18) in said storage bay (16);

wherein said means (20) for drawing a respective reel (12) comprise an organ for gripping the reel (40) having at least a first pair of tines (42, 44) extending parallel to each other and a second pair of tines (46, 48) extending parallel to each other and substantially orthogonal to said first pair of tines (42, 44), said first and second pair of tines adapted to support from underneath the reel, respectively, in a position of drawing from and releasing to the respective housing and in a position of releasing to and drawing from the delivery means.

19. Apparatus for supplying a ribbon-like material, in particular a fabric, to at least one work machine (14*a*, 14*b*, 14*c*) of said material, in particular to at least one machine for cutting the material into predetermined shaped portions, said apparatus comprising a storage bay (16) having a plurality of predefined housings (18) for storing a respective individual reel (12) supporting a respective ribbon-like material, means (19) for supplying the material to the machine (14*a*, 14*b*, 14*c*), means (20) for drawing a respective reel (12); and control means (EE) able to command the gripping of a reel (12), by said drawing means (20), from a predefined housing (18)

and the delivery to said means (19) for delivering the material of a respective work machine (14*a*, 14*b*, 14*c*) and, vice versa, to command, by said drawing means (20), the gripping of the reel by said means (19) for supplying the ribbon-like material, and the release of said reel (12) to the corresponding housing (18) in said storage bay (16);

wherein said means (20) for drawing a respective reel (12) comprise an organ for gripping the reel (40) having at least first and second mutually parallel tines (42, 44); and wherein each of said tines (42, 44, 46, 48) has a free end having a portion (50) that projects perpendicularly from the respective tine to retain said reel (12).

20. Apparatus for supplying a ribbon-like material, in particular a fabric, to a plurality of work machines (14*a*, 14*b*, 14*c*) of said material, longitudinally extending parallel to each other, in particular to a plurality of machines for cutting the material into predetermined shaped portions, said apparatus comprising a storage bay (16) having a front end and a plurality of predefined housings (18) for storing a respective reel (12) supporting a respective ribbon-like material, said housings (18) extending transversely to the plurality of working machines;

means (19) for supplying the material to a respective machine (14*a*, 14*b*, 14*c*), means (20) for drawing a respective reel (12); and control means (EE) able to command the gripping of a reel (12), by said drawing means (20), from a predefined housing (18)

and the delivery to said means (19) for delivering the material of a respective work machine (14*a*, 14*b*, 14*c*) and, vice versa, to command, by said drawing means (20), the gripping of the reel by said means (19) for supplying the ribbon-like material, and the release of said reel (12) to the corresponding housing (18) in said storage bay (16);

wherein said drawing means (20) comprise at least a movable assembly (45) having means (54) for supporting an organ (40) for gripping the reel; and wherein said movable assembly is actuated to move along guiding tracks (56, 58) which extend parallel to the drawing front face of said storage bay (16), and transversely to the means for supplying the material to the work machines (14*a*, 14*b*, 14*c*).

21. Apparatus as claimed in claim 20, wherein said support means for the gripping organ (40) are in the form of a movable arm (54).

22. Apparatus for supplying a ribbon-like material, in particular a fabric, to at least one work machine (14*a*, 14*b*, 14*c*) of said material, in particular to at least one machine for cutting the material into predetermined shaped portions, said apparatus comprising a storage bay (16) having a plurality of predefined housings (18) for storing a respective reel (12) supporting a respective ribbon-like material, means (19) for supplying the material to a respective machine (14*a*, 14*b*, 14*c*), means (20) for drawing a respective reel (12); and control means (EE) able to command the gripping of a reel (12), by said drawing means (20), from a predefined housing (18)

and the delivery to said means (19) for delivering the material of a respective work machine (14*a*, 14*b*, 14*c*) and, vice versa, to command, by said drawing means (20), the gripping of the reel by said means (19) for supplying the ribbon-like material, and the release of said reel (12) to the corresponding housing (18) in said storage bay (16);

wherein said drawing means (20) comprise at least a movable assembly (45) having means (54) for supporting an organ (40) for gripping the reel;

said means (20) for drawing a respective reel (12), comprising an organ for gripping the reel (40) and means to impart a rotation, in the two opposite angular direction, to obtain the upsetting of said organ (40) for gripping the reel between a position of drawing from and releasing to the respective housing (18) and in a position of releasing to and drawing from the delivery means (19).

23. Apparatus as claimed in claim 22, wherein said support means for the gripping organ (40) are in the form of a movable arm (54).

24. Apparatus for supplying a ribbon-like material, in particular a fabric, to at least one work machine (14*a*, 14*b*, 14*c*) of said material, in particular to at least one machine for cutting the material into predetermined shaped portions, said apparatus comprising a storage bay (16) having a plurality of predefined housings (18) for storing a respective individual reel (12) supporting a respective ribbon-like material, means (19) for supplying the material to the machine (14*a*, 14*b*, 14*c*), means (20) for drawing a respective reel (12); and control means (EE) able to command the gripping of a reel (12), by said drawing means (20), from a predefined housing (18)

and the delivery to said means (19) for delivering the material of a respective work machine (14*a*, 14*b*, 14*c*) and, vice versa, to command, by said drawing means (20), the gripping of the reel by said means (19) for supplying the ribbon-like material, and the release of said reel (12) to the corresponding housing (18) in said storage bay (16);

wherein said means (19) for supplying the material to the respective machine (14*a*, 14*b*, 14*c*) are means for supporting and unrolling the material from the reel (12) in the form of roller means subdivided into a plurality of sections set transversely side by side (32*a*, 32*b*, 32*c*) so as to define at least a first and a second passage (34, 36) for the insertion of the tines of a fork for drawing the reel (12).

25. Apparatus as claimed in claim 24, wherein each section (32*a*, 32*b*, 32*c*) of said rollers comprises at least a first and a second longitudinally distanced rollers (321, 322), situated at the same level or height, whereon the reel (12) is laid down with its outer surface (12').

26. Apparatus as claimed in claim 25, wherein each section (32*a*, 32*b*, 32*c*) of said rollers comprises a third roller (323) placed in intermediate longitudinal position relative to said first and second roller (321, 322), and situated at a lower level relative thereto, to define a further bearing point for the substantially cylindrical outer surface (12') of the reel (12).

27. Apparatus as claimed in claim 24, wherein lateral guidance means for the tines of the organ for gripping the reel, when they are introduced into said insertion passages (34, 36), are provided on said means (19) for supplying the material to the respective machine (14*a*, 14*b*, 14*c*).

28. Apparatus as claimed in claim 24, wherein the rollers (321, 322, 323) of said roller sections (32*a*, 32*b*, 32*c*) are supported able to rotate by means of lateral vertical walls (301) and intermediate walls (303, 304, 305, 306) of said frame (30) in such a way that said passages (34, 36) for the tines of the fork are defined between respective intermediate walls (303, 304, 305, 306), providing said lateral guidance means for the tines of the reel grip organ which are introduced into said passages (34, 36).

29. Apparatus for supplying a ribbon-like material, in particular a fabric, to at least one work machine (14*a*, 14*b*, 14*c*) of said material, in particular to at least one machine for cutting the material into predetermined shaped portions, said apparatus comprising a storage bay (16) having a plurality of predefined housings (18) for storing a respective individual reel (12) supporting a respective ribbon-like material, means (19) for supplying the material to the machine (14*a*, 14*b*, 14*c*), means (20) for drawing a respective reel (12); and control means (EE) able to command the gripping of a reel (12), by said drawing means (20), from a predefined housing (18)

and the delivery to said means (19) for delivering the material of a respective work machine (14*a*, 14*b*, 14*c*) and, vice versa, to command, by said drawing means (20), the gripping of the reel by said means (19) for supplying the ribbon-like material, and the release of said reel (12) to the corresponding housing (18) in said storage bay (16);

wherein the housings (18) have a base (25) extending horizontally for bearing the reel (12) and first and second slits (26, 28) for the insertion of the tines (42, 44) of a fork (40) for drawing the reel (12).

* * * * *